US011795624B2

(12) United States Patent
Schulte et al.

(10) Patent No.: US 11,795,624 B2
(45) **Date of Patent: *Oct. 24, 2023**

(54) THROUGH-AIR DRIED TISSUE PRODUCTS COMPRISING REGENERATED CELLULOSE FIBER

(71) Applicant: Kimberly-Clark Worldwide, Inc., Neenah, WI (US)

(72) Inventors: Emily Schulte, Neenah, WI (US); Richard L. Underhill, Neenah, WI (US); Jessica N. Sherek, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/515,814

(22) Filed: Nov. 1, 2021

(65) Prior Publication Data

US 2023/0133946 A1 May 4, 2023

(51) Int. Cl.
*D21H 27/00* (2006.01)
*D21H 13/08* (2006.01)

(52) U.S. Cl.
CPC ..... *D21H 27/005* (2013.01); *D21H 13/08* (2013.01)

(58) Field of Classification Search
CPC ..... D21H 27/005; D21H 13/08; D21H 11/02; D21H 11/04; D21H 11/06; D21H 13/06; A47K 10/16
See application file for complete search history.

(56) References Cited

U.S. PATENT DOCUMENTS 6,461,476 B1 * 10/2002 Goulet ..... D21H 23/765 162/158
6,602,386 B1 * 8/2003 Takeuchi ..... D21H 13/08 162/146
6,841,038 B2 * 1/2005 Horenziak ..... D21H 13/08 428/326
7,985,321 B2 * 7/2011 Sumnicht ..... D21F 11/14 162/146

(Continued)

FOREIGN PATENT DOCUMENTS

CA 2843521 C * 1/2021 ..... B32B 29/005
CN 203715868 U 7/2014

(Continued)

OTHER PUBLICATIONS

Harter, Thomas et al., "Dispersibility of hydroentangled wetlaid nonwovens", Proceedings of the 16th Minisymposium Verfahrenstechnik and 7th Partikelforum , Dec. 2020, https://repositum.tuwien.at/bitstream/20.500.12708/16663/1/DiP3_08.pdf.

(Continued)

*Primary Examiner* — Jose A Fortuna
(74) *Attorney, Agent, or Firm* — Kimberly-Clark Worldwide, Inc.

(57) ABSTRACT

The present invention provides a wet-laid tissue product comprising regenerated cellulose fibers that can provide 25 percent or less of the total weight of the wet-laid tissue product. The regenerated cellulose fibers can have a linear density of less than about 1.5 dtex and a fiber length of less than 6.0 mm. The wet-laid tissue product can provide improvements in softness at a given strength. The products may also have improved wet physical properties when regenerated cellulose fibers are presented, such as improved wet tensile strength and wet burst. The improvement in wet physical properties does not come at the expense of dispersibility, as the products are readily dispersible and, in some (Continued)

instances, have improved dispersibility compared to similar products prepared entirely from conventional wood pulp fibers.

15 Claims, 4 Drawing Sheets

(56) References Cited

U.S. PATENT DOCUMENTS

| | | | | |
|---|---|---|---|---|
| 8,030,231 | B2 | 10/2011 | Lange et al. | |
| 8,216,425 | B2 * | 7/2012 | Sumnicht | D21C 9/005 162/146 |
| 8,637,728 | B2 | 1/2014 | Fingal et al. | |
| 9,744,248 | B2 * | 8/2017 | Zawadzki | A61K 47/595 |
| 10,047,458 | B2 | 8/2018 | Bernt et al. | |
| 10,604,897 | B2 | 3/2020 | Goldhalm et al. | |
| 2003/0056916 | A1 * | 3/2003 | Horenziak | D21H 13/08 162/173 |
| 2006/0019571 | A1 * | 1/2006 | Lange | D04H 1/425 442/403 |
| 2007/0224419 | A1 * | 9/2007 | Sumnicht | D21C 9/005 428/364 |
| 2018/0142419 | A1 * | 5/2018 | Rouse | D21H 27/42 |
| 2022/0325476 | A1 * | 10/2022 | Shi | D21H 13/08 |
| 2022/0325479 | A1 * | 10/2022 | Shi | D04H 1/44 |
| 2023/0133946 | A1 * | 5/2023 | Schulte | D21H 13/08 162/109 |

FOREIGN PATENT DOCUMENTS

| | | | | | |
|---|---|---|---|---|---|
| CN | 104562831 | B | | 1/2017 | |
| CN | 110139961 | B | * | 1/2023 | B32B 29/005 |
| EP | 2004904 | B1 | * | 10/2014 | A47L 13/16 |
| EP | 2027314 | B1 | | 12/2014 | |
| EP | 2985375 | B1 | | 3/2017 | |
| GB | 2549400 | A | * | 10/2017 | A47K 10/16 |
| JP | 2006002277 | A | | 1/2006 | |
| JP | 2008095223 | A | | 4/2008 | |
| JP | 2010195735 | A | | 9/2010 | |
| JP | 2016089277 | A | * | 5/2016 | |
| WO | WO-2009038730 | A1 | * | 3/2009 | D21H 13/08 |
| WO | WO-2020256684 | A1 | * | 12/2020 | D04H 1/26 |

OTHER PUBLICATIONS

Wang, Sen et al., "Recent advances in regenerated cellulose materials", Progress in Polymer Science, vol. 53, pp. 169-206, Feb. 2016, https://www.sciencedirect.com/science/article/pii/S007967001500074X.

Tu, Hu et al., "Recent Progress in High-Strength and Robust Regenerated Cellulose Materials", Advanced Materials, Jul. 19, 2020, https://onlinelibrary.wiley.com/doi/abs/10.1002/adma.202000682.

* cited by examiner

THROUGH-AIR DRIED TISSUE PRODUCTS COMPRISING REGENERATED CELLULOSE FIBER

BACKGROUND OF THE DISCLOSURE

Tissue products, such as facial tissues, paper towels, bath tissues, napkins, and other similar products, are designed to include several important properties. For example, the products should have good bulk, a soft feel, and should have good strength and durability. Unfortunately, however, when steps are taken to increase one property of the product, other characteristics of the product are often adversely affected.

To achieve the optimum product properties, tissue products are typically formed, at least in part, from pulps containing wood fibers and often a blend of hardwood and softwood fibers to achieve the desired properties. For example, one common practice in the manufacture of tissue products is to provide two furnishes (or sources) of wood pulp fiber. Sometimes, a two-furnish system is used in which the first furnish comprises a wood pulp fiber having a relatively short fiber length, such as a hardwood kraft pulp fiber, and the second furnish is made of wood pulp fiber having a relatively long fiber length, such as softwood kraft pulp fiber. The short fiber furnish may be used to provide the finished product with a softer handfeel, while the long fiber furnish may be used to provide the finished product with strength.

Typically, when attempting to optimize surface softness, as is often the case with tissue products, the papermaker will select the fiber furnish based in part on the coarseness of pulp fibers. Pulps having fibers with low coarseness are desirable because tissue paper made from fibers having a low coarseness can be made softer than similar tissue paper made from fibers having a high coarseness. To optimize surface softness even further, premium tissue products usually comprise layered structures where the low coarseness fibers are directed to the outer layer of the tissue sheet with the inner layer of the sheet comprising longer, coarser fibers.

Unfortunately, the need for softness is balanced by the need for strength. Tissue product strength can be measured by calculating the tensile strength of the tissue product. However, tensile strength of a tissue product is generally inversely related to softness, and thus, the paper maker is continuously challenged with the need to balance the need for softness with the need for strength. Additionally, while tensile strength is one measure of tissue strength, other properties such as tensile energy absorbed (TEA), tear strength, and wet burst strength are also important to strength or durability of the tissue in use.

Thus, there remains a need for improvements in the manufacture of tissue products, which must be both soft and strong.

SUMMARY OF THE DISCLOSURE

The present inventors have invented novel tissue products, particularly uncreped, through-air dried tissue products, and more particularly uncreped, through-air dried rolled bath tissue products, comprising regenerated cellulose, having improved strength, softness and bulk. In certain instances, the improved product properties are achieved by replacing conventional wood pulp fibers with regenerated cellulose fibers that surprisingly still provide adequate strength, softness, and bulk, particularly when the regenerated cellulose fibers are selectively disposed in one or more layers of a layered tissue towel product.

To produce the instant tissue products the inventors have successfully moderated the changes in strength, softness and bulk typically associated with substituting conventional wood pulp fibers with regenerated cellulose fibers by selectively disposing the regenerated cellulose fibers in one or more layers of a layered tissue towel product. Accordingly, in certain preferred embodiments, the invention provides tissue products in which regenerated cellulose fibers replace other fibers of the tissue product without negatively affecting the tissue product's strength, softness or bulk. In a particularly preferred embodiment, the regenerated cellulose fibers are disposed in each of the outer most layers of a layered tissue web.

In one embodiment the present invention provides an uncreped, through-air dried, tissue product comprising at least about 5 weight percent regenerated cellulose fibers, such as from about 5 to about 25 weight percent, more preferably from about 5 to about 15 weight percent regenerated cellulose fibers, based upon the total weight of the product. The regenerated cellulose fibers preferably have a linear density less than 1.5 dtex, more preferably less than about 1.0 dtex, still more preferably less than about 0.9 dtex, such as from about 0.3 to about 1.5 dtex, and a fiber length of less than 6.0 mm, such as from about 1.5 to about 6.0 mm.

In another embodiment the present invention provides an uncreped, through-air dried, tissue product comprising from about 5 to about 25 weight percent regenerated cellulose fibers, the tissue product having a basis weight from about 30 to about 50 grams per square meter (gsm), a geometric mean tensile (GMT) strength of about 700 g/3" or greater and a TS7 value less than about 10.0 and more preferably from about 7.0 to about 10.0.

In yet another embodiment the present invention provides a tissue product consisting of a single, uncreped, through-air dried tissue ply comprising from about 5 to about 20 weight percent regenerated cellulose fibers, the tissue product having a geometric mean tensile (GMT) strength from about 700 to about 1,200 g/3" and a TS7 value from about 7.0 to about 10.0.

In still other embodiments the present invention provides a single-ply through-air dried tissue product comprising from about 5 to about 25 weight percent regenerated cellulose, the product having a machine direction slope (MD Slope) from about 3.00 to about 7.0 kg.

In yet other embodiments the present invention provides a through-air dried tissue product comprising from about 5 to about 25 weight percent regenerated cellulose, the product having a geometric mean tensile strength of from about 700 to about 1,200 g/3" and a CD Wet Tensile of about 180 g/3" or greater.

BRIEF DESCRIPTION OF THE DRAWINGS

A full and enabling disclosure thereof, directed to one of ordinary skill in the art, is set forth more particularly in the remainder of the specification, which makes reference to the appended figures in which.

DEFINITIONS

Figure 1:
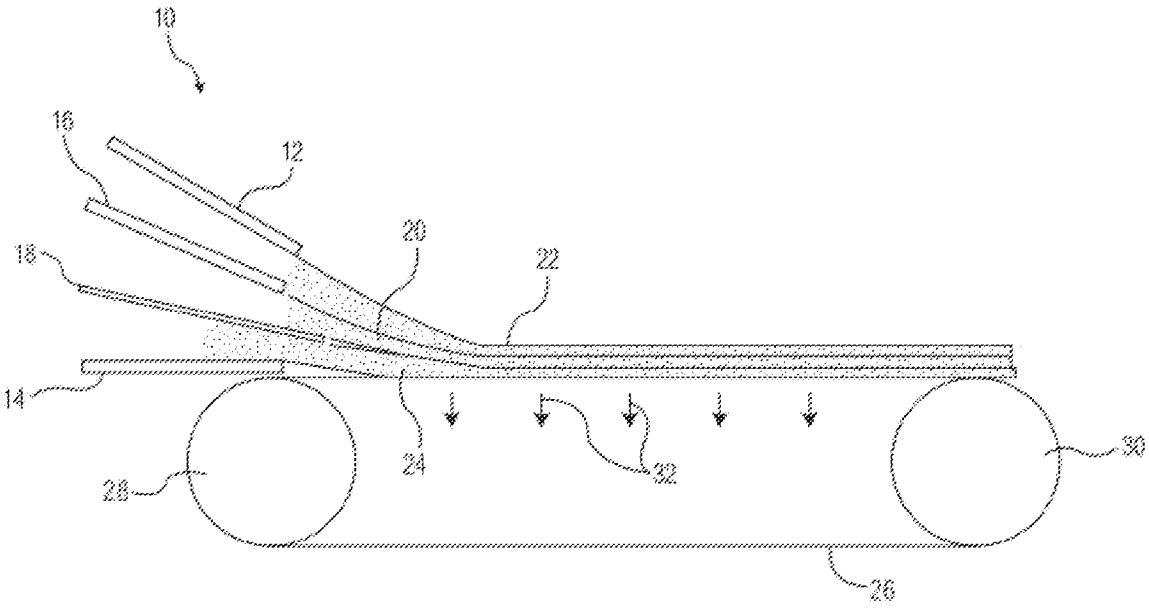
FIG. 1 illustrates one device useful for forming a multi-layered web according to the present invention.

As used herein, the term 'tissue product' generally refers to products made from one or more tissue plies, also referred to herein as webs, and includes various paper products, such as facial tissue, bath tissue, paper towels, napkins, wipers, medical pads, and the like.

The term "ply" refers to a discrete product element. Individual plies may be arranged in juxtaposition to each other. The term may refer to a plurality of web-like components in facing arrangement with one another such as in a multi-ply facial tissue, bath tissue, paper towel, wipe, or napkin.

As used herein, the term "layer" refers to a plurality of strata of fibers, chemical treatments, or the like within a ply.

As used herein, the terms "layered tissue web," "multi-layered tissue web," "multi-layered web," and "multi-layered paper sheet," generally refer to sheets of paper prepared from two or more layers of aqueous papermaking furnish which are preferably comprised of different fiber types. The layers are preferably formed from the deposition of separate streams of dilute fiber slurries, upon one or more endless foraminous screens. If the individual layers are initially formed on separate foraminous screens, the layers are subsequently combined (while wet) to form a layered composite web.

As used herein, the term "fiber" means an elongate particulate having an apparent length greatly exceeding its apparent width. More specifically, and as used herein, fiber means such fibers suitable for a papermaking process and more particularly the tissue paper making process.

As used herein, the term "regenerated cellulose" refers to fibers that are derived from cellulose, and more preferably, wood cellulose, that are dissolved, purified, and extruded. Regenerated cellulose fibers are generally distinguishable from synthetic fibers, which are generally non-cellulosic, thermoplastic fibers.

As used herein, the term "thermoplastic" means a plastic which becomes pliable or moldable above a specific temperature and returns to a solid state upon cooling. Exemplary thermoplastic fibers can include polyesters (e.g., polyalkylene terephthalates such as polyethylene terephthalate (PET), polybutylene terephthalate (PBT) and the like), polyalkylenes (e.g., polyethylenes, polypropylenes and the like), polyacrylonitriles (PAN), and polyamides (nylons, for example, nylon-6, nylon 6,6, nylon-6,12, and the like).

As used herein, the term "fiber length" is defined and measured according to the Fiber Length Test as described in the Test Methods section.

As used herein, the term "denier" refers to a unit of measure for the linear mass density of fibers. Fiber denier is to be measured according to ASTM D-1577, "Standard Test Methods for Linear Density of Textile Fibers." Denier may be used herein interchangeably with Decitex (dtex). Generally, 1 Denier (den)=1.111 Decitex (dtex).

As used herein the term "basis weight" generally refers to the conditioned weight per unit area of a tissue and is generally expressed as grams per square meter (gsm). Basis weight is measured as described in the Test Methods section below. While the basis weights of tissue products prepared according to the present invention may vary, in certain embodiments the products have a basis weight greater than about 30 gsm, such as greater than about 40 gsm, such as greater than about 45 gsm, such as from about 30 to about 100 gsm, such as from about 30 to about 70 gsm, such as from about 30 to about 50 gsm.

As used herein, the term "Caliper" refers to the thickness of a tissue product, web, sheet or ply, typically having units of microns (μm) and is measured as described in the Test Methods section below.

As used herein, the term "Bulk" refers to the quotient of the caliper (μm) of a product or ply divided by the bone dry basis weight (gsm). The resulting bulk is expressed in cubic centimeters per gram (cc/g). Tissue products prepared according to the present invention may, in certain embodiments, have a bulk greater than about 10.0 cc/g, more preferably greater than about 12.0 cc/g and still more preferably greater than about 14.0 cc/g, such as from about 10.0 to about 20.0 cc/g.

As used herein, the term "Slope" refers to the slope of the line resulting from plotting tensile versus stretch and is an output of the MTS TestWorks™ in the course of determining the tensile strength as described in the Test Methods section herein. Slope is reported in the units of grams (g) per unit of sample width (inches) and is measured as the gradient of the least-squares line fitted to the load-corrected strain points falling between a specimen-generated force of 70 to 157 grams (0.687 to 1.540 N) divided by the specimen width.

As used herein, the term "Geometric Mean Slope" (GM Slope) generally refers to geometric mean modulus of a product and is equal to the square root of the product of machine direction slope and cross-machine direction slope. While the GM Slope may vary amongst tissue products prepared according to the present disclosure, in certain embodiments, tissue products may have a GM Slope less than about 10.0 kg, more preferably less than about 9.0 kg and still more preferably less than about 8.0 kg, such as from about 6.0 to about 10.0 kg, such as from about 6.0 to about 8.0 kg.

As used herein, the term "Geometric Mean Tensile" (GMT) refers to the square root of the product of the machine direction tensile strength and the cross-machine direction tensile strength of the web.

As used herein, the term "Stiffness Index" refers to the quotient of the geometric mean tensile slope, defined as the square root of the product of the MD and CD slopes (having units of kg), divided by the geometric mean tensile strength (having units of grams per three inches).

$$\text{Stiffness Index} = \frac{\sqrt{MD\ \text{Tensile Slope (kg)} \times CD\ \text{Tensile Slope (kg)}}}{GMT\ (g/3'')} \times 1{,}000$$

While the Stiffness Index of tissue products prepared according to the present disclosure may vary, in certain instances the Stiffness Index ranges from about 2.0 to about 3.00.

As used herein, the term "Burst Index" refers the dry burst strength (having units of grams force) at a given geometric mean tensile strength (having units of grams per three inches) as defined by the equation:

$$\text{Burst Index} = \frac{\text{Dry Burst Strength } (gf)}{GMT\,(g/3")} \times 10$$

While the Burst Index may vary, in certain instances tissue products prepared according to the present invention have a Burst Index greater than about 9.00, such as greater than about 9.50, such as greater than about 10.00, such as from about 9.00 to about 12.00.

As used herein, the term "Slosh" generally refers to the time needed to break-up a tissue sample into pieces less than 25×25 mm using the Slosh test as described in the Test Methods section below. Generally, Slosh has units of seconds or minutes. The Slosh test uses a bench-scaled apparatus to evaluate the breakup or dispersibility of flushable consumer products as they travel through the wastewater collection system.

As used herein, the term "CD Wet/Dry" refers to the ratio of the wet cross-machine direction (CD) tensile strength to the dry CD tensile strength. Wet and dry CD tensile are measured as set forth in the Test Methods section below. The CD Wet/Dry of inventive tissue products may vary, however, in certain instances the inventive tissue products may have a CD Wet/Dry greater than about 0.100, such as greater than about 0.150, such as greater than about 0.175, such as from about 0.100 to about 0.200, such as from about 0.150 to about 0.200.

As used herein, the term "TS7" generally refers to the softness of a tissue product surface measured using an EMTEC Tissue Softness Analyzer ("EMTEC TSA") (EMTEC Electronic GmbH, Leipzig, Germany) interfaced with a computer running EMTEC TSA software (version 3.19 or equivalent). The units of the TS7 are dB V2 rms, however, TS7 values are often referred to herein without reference to units. Generally, the TS7 is the magnitude of the peak occurring at a frequency between 6 and 7 kHz which is produced by vibration of the tissue product during the test procedure. Generally, a peak in this frequency range having a lower amplitude, and hence a lower TS7 value, is indicative of a softer tissue product.

As used herein the term "substantially free" refers to the composition of one layer of a multi-layered web which comprises less than about 1.0 percent, by weight of the given layer, regenerated cellulose. The foregoing amounts of fiber are generally considered negligible and do not affect the physical properties of the layer. Moreover, the presence of negligible amounts of regenerated cellulose in a given layer generally arise from regenerated cellulose applied to an adjacent layer and have not been purposefully disposed in a given layer.

DETAILED DESCRIPTION OF THE DISCLOSURE

The present invention generally provides tissue products having improved softness and wet strength properties, such as wet cross-machine direction tensile and wet burst. The improvement in softness and wet strength properties is generally achieved by substituting conventional wood pulp fibers with regenerated cellulose fibers and more particularly by selectively disposing the regenerated cellulose fibers in one or more layers of a layered tissue web used to form the tissue product. Accordingly, in certain preferred embodiments, the invention provides tissue products in which regenerated cellulose fibers replace other fibers of the tissue product without negatively effecting the tissue product's softness and wet strength properties.

Regenerated cellulose fibers may replace wood pulp fibers and more particularly wood kraft pulp fibers commonly used in the manufacture of tissue products. Surprisingly, regenerated cellulose fibers may be used as a replacement for either, or both, long and short wood pulp fibers. For example, in certain embodiments, regenerated cellulose fibers are substituted for long wood pulp fibers, such as Northern softwood kraft pulp fibers (NSWK), and selectively incorporated into a single layer of a multi-layered tissue web. In other embodiments, regenerated cellulose fibers are a substitute for both long and short wood kraft pulp fibers, such as NSWK and eucalyptus hardwood kraft (EHWK) fibers, and are disposed in one or more layers of a multi-layered web or incorporated into a non-stratified, blended web.

In certain embodiments the regenerated cellulose fibers are selectively disposed in an inner layer of a multi-layered web. For example, the regenerated cellulose fibers may be selectively disposed in the center layer of a three-layered tissue web, such that the fibers are generally not present in the outer surfaces of the web. In a particularly preferred embodiment, the regenerated cellulose may be disposed in a middle layer of tissue web as a substitute for long wood pulp fibers, such as NSWK. Surprisingly, the softness of the product may be increased by selectively disposing regenerated cellulose fibers in the middle layer while still bringing about an improvement in wet strength properties, such as wet tensile strength and wet burst.

In other embodiments the present invention provides tissue products comprising one more stratified tissue webs where regenerated cellulose fibers are disposed in at least one layer of the stratified web and more preferably an outer layer of the web such that the fibers form an outer surface of the resulting tissue product. For example, in one particular embodiment of the present invention, the web comprises first and second outer layers forming the first and second surfaces of the web, and a middle layer disposed therebetween. Each outer layer can comprise from about 15 to about 40 percent by weight of the web and particularly from about 20 to about 35 percent by weight of the web. The middle layer, however, can comprise from about 40 to about 60 percent by weight of the web, and particularly about 50 percent by weight of the web. Regenerated fibers may be selectively disposed in each of the two outer layers and the middle layer may be substantially free from regenerated cellulose Regardless of the manner in which regenerated cellulose fibers are incorporated into the products of the present invention, they are preferably added in relatively modest amounts. According, the products generally comprise about 25 weight percent or less, based on the total weight of the web regenerated cellulose fibers, more preferably about 20 weight percent or less and still more preferably about 15 weight percent or less, such as from about 1.0 to about 25 weight percent, more preferably from about 5.0 to about 20 weight percent and still more preferably from about 5.0 to about 10 weight percent.

Generally, the regenerated cellulose have a fiber length of 5.0 mm or less, more preferably 4.0 mm or less and still more preferably 3.0 mm or less, such as from 2.5 to 5.0 mm, such as from 2.5 to 4.0 mm, such as from 2.5 to 3.0 mm. The regenerated cellulose fibers may have a linear density ranging from about 0.3 dtex to about 6 dtex, from about 0.5 dtex to about 5 dtex, or from about 0.9 dtex to about 2.0 dtex, specifically reciting all values within these ranges and any ranges created thereby. In a particularly preferred embodiment, the regenerated cellulose has a fiber length from 1.5 to 3.0 mm and linear density of about 1.0 dtex or less. Suitable regenerated cellulose fibers are commercially available from Kelheim Fibres GmbH (Kelheim, Germany).

In certain embodiments the tissue products may contain wood pulp fibers, such as a mixture of hardwood and softwood kraft pulp fibers. For example, the product may comprise a stratified web having first and second outer layers comprising EHWK and a middle layer comprising NSWK or a mixture of Southern softwood kraft pulp fibers (SSWK) and NSWK. In other instance one or more layers may comprise bleached chemi-thermomechanical pulp (BCTMP) softwood fibers. Regardless of the precise layering structure or furnish composition it is generally preferred that a portion of the wood pulp furnish is substituted with regenerated cellulose such that the total amount of regenerated cellulose fibers is about 20 weight percent or less, or in some embodiments 15 weight percent or less, or in some embodiments 10 weight percent or less of the total weight of the tissue product.

In certain embodiments one or more layers of a stratified web, such as the middle layer of a three layered web, may be formed without a substantial amount of inner fiber-to-fiber bond strength. In this regard, the fiber furnish used to form one or more layers can be treated with a chemical debonding agent. The debonding agent can be added to the fiber slurry during the pulping process or can be added directly into the headbox. Suitable debonding agents that may be used in the present invention include cationic debonding agents, particularly quaternary ammonium compounds, mixtures of quaternary ammonium compounds with polyhydroxy compounds, and modified polysiloxanes.

Suitable cationic debonding agents include, for example, fatty dialkyl quaternary amine salts, mono fatty alkyl tertiary amine salts, primary amine salts, imidazoline quaternary salts, silicone quaternary salt and unsaturated fatty alkyl amine salts. Other suitable debonding agents are disclosed in U.S. Pat. No. 5,529,665, the contents of which are incorporated herein in a manner consistent with the present disclosure.

In one embodiment, the debonding agent used in the process of the present invention is an organic quaternary ammonium chloride and particularly a silicone based amine salt of a quaternary ammonium chloride. Useful debonders are commercially available under the tradename ProSoft (commercially available from Solenis, Wilmington, DE). The debonding agent can be added to the fiber slurry in an amount of from about 1.0 kg per metric tonne to about 15 kg per metric tonne of fibers present within the slurry.

Particularly useful quaternary ammonium debonders include imidazoline quaternary ammonium debonders, such as oleyl-imidazoline quaternaries, dialkyl dimethyl quaternary debonders, ester quaternary debonders, diamidoamine quaternary debonders, and the like. The imidazoline-based debonding agent can be added in an amount of between 1.0 to about 10 kg per metric tonne.

In another embodiment, a layer or other portion of the web, including the entire web, can be provided with wet or dry strength agents. As used herein, "wet strength agents" are materials used to immobilize the bonds between fibers in the wet state. Any material that when added to a tissue web or sheet at an effective level results in providing the sheet with a wet geometric tensile strength:dry geometric tensile strength ratio in excess of 0.1 will, for purposes of this invention, be termed a wet strength agent. Typically, these materials are termed either as permanent wet strength agents or as "temporary" wet strength agents. For the purposes of differentiating permanent from temporary wet strength, permanent will be defined as those resins which, when incorporated into paper or tissue products, will provide a product that retains more than 50 percent of its original wet tensile strength after exposure to water for a period of at least five minutes. Temporary wet strength agents are those which show less than 50 percent of their original wet strength after being saturated with water for live minutes. Both classes of material find application in the present invention. The amount of wet strength agent or dry strength added to the pulp fibers can be at least about 0.1 dry weight percent, more specifically about 0.2 dry weight percent or greater, and still more specifically from about 0.1 to about 3 dry weight percent, based on the dry weight of the fibers.

Suitable temporary wet strength resins include, but are not limited to, those resins described in U.S. Pat. Nos. 3,556,932 and 3,556,933. Other temporary wet strength agents that should find application in this invention include modified starches.

Tissue webs, also referred to herein as basesheets, useful in forming tissue products according to the present invention may be manufactured using a variety of wet-laid papermaking processes known in the art. For example, a papermaking process of the present disclosure can utilize wet-pressing, air pressing, through-air drying, creped through-air drying, uncreped through-air drying, as well as other steps in forming the tissue web. Examples of papermaking processes and techniques useful in forming tissue webs according to the present invention include, for example, those disclosed in U.S. Pat. Nos. 5,048,589, 5,399,412, 5,129,988 and 5,494,554 all of which are incorporated herein in a manner consistent with the present disclosure. In one embodiment the tissue web is wet-laid, through-air dried and uncreped.

In certain preferred embodiments the tissue products of the present invention comprise one or more tissue plies, where an individual tissue ply comprises multiple layers of fiber furnish using manufacturing techniques well-known in the art, such as stratified headbox. Layered webs produced by any means known in the art, however, are within the scope of the present invention, including those disclosed in U.S. Pat. No. 5,494,554, which is incorporated herein by reference in a manner consistent with the present disclosure.

Referring to FIG. 1, one embodiment of a device for forming a multi-layered stratified pulp furnish is illustrated. As shown, a three-layered headbox 10 generally includes an upper headbox wall 12 and a lower headbox wall 14. Headbox 10 further includes a first divider 16 and a second divider 18, which separate three fiber stock layers.

Each of the fiber layers comprises a dilute aqueous suspension of papermaking fibers. In one embodiment, for instance, middle layer 20 contains softwood kraft fibers either alone or in combination with other fibers such as high yield fibers. At least one of the outer layers 22 and 24, on the other hand, contain short, low coarseness cellulosic fibers, such as hardwood kraft pulp fibers and more preferably Eucalyptus kraft pulp fibers.

An endless traveling forming fabric 26, suitably supported and driven by rolls 28 and 30, receives the layered papermaking stock issuing from headbox 10. Once retained on fabric 26, the layered fiber suspension passes water through the fabric as shown by the arrows 32. Water removal is achieved by combinations of gravity, centrifugal force and vacuum suction depending on the forming configuration.

Forming multi-layered tissue webs is also described and disclosed in U.S. Pat. No. 5,129,988, the contents of which are incorporated herein in a manner consistent with the present disclosure.

The basis weight of tissue webs used in the process of the present invention can vary depending upon the final product. For example, the process of the present invention can be used to produce facial tissues, bath tissues, paper towels, industrial wipers, and the like. For these products, the basis weight may be about 30 gsm or greater, such as greater than about 40 gsm, such as greater than about 45 gsm, such as from about 30 to about 100 gsm, such as from about 30 to about 70 gsm, such as from about 30 to about 50 gsm.

As stated above, the manner in which the tissue web is formed can also vary depending upon the particular application. In general, the tissue web can be formed by any of a variety of papermaking processes known in the art. For example, the tissue web may comprise a through-air dried web such as an uncreped through-air dried web. Other through-air dried webs that may be used in the present invention include pattern-densified or imprinted webs. In another alternative embodiment, the tissue web may be made according to an air forming process.

Figure 2:
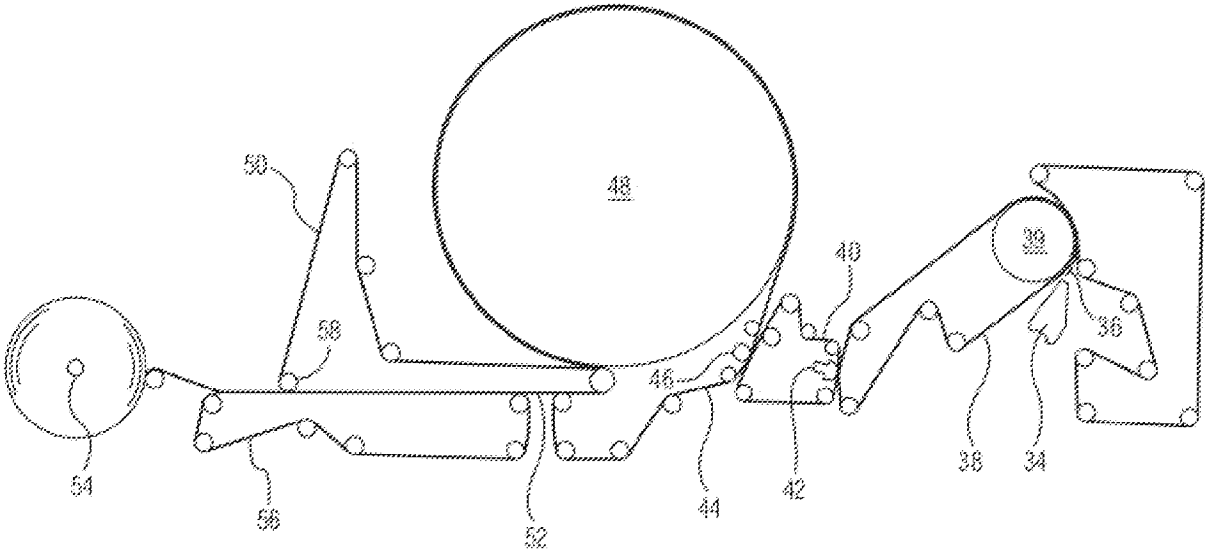
FIG. 2 is a schematic illustration of a process for making through-air dried paper sheets that may be used in accordance with this invention.
Figure 3:
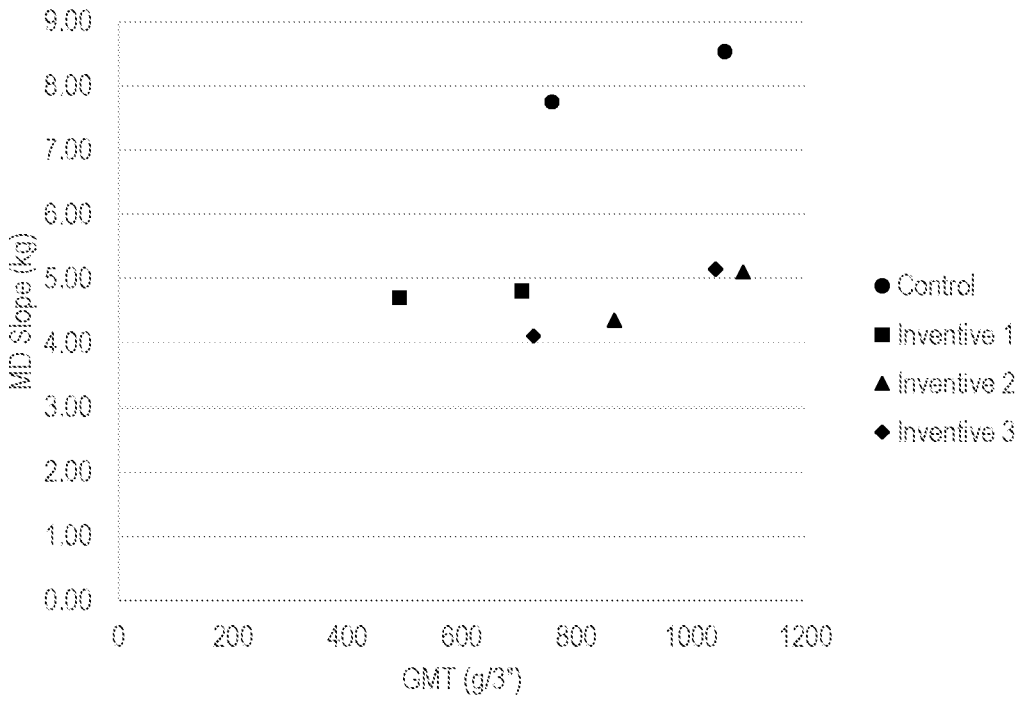
FIG. 3 is a graph illustrating machine direction mean slope (MD Slope) having units of kilograms versus geometric mean tensile (GMT) having units of grams per three inches for various samples prepared as described herein.
Figure 4:
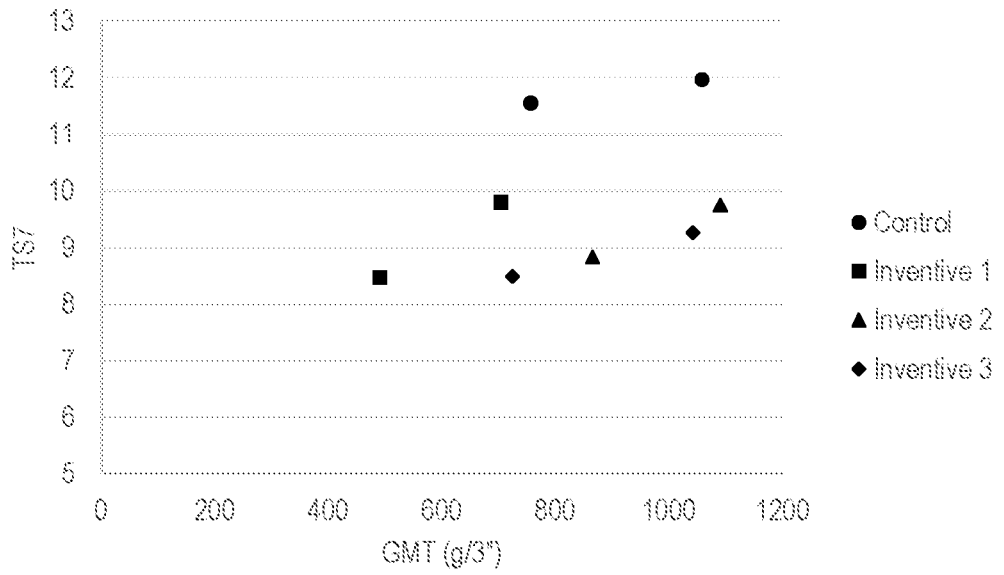
FIG. 4 is a graph illustrating TS7 Softness values versus GMT values for various samples prepared as described herein.
Figure 5:
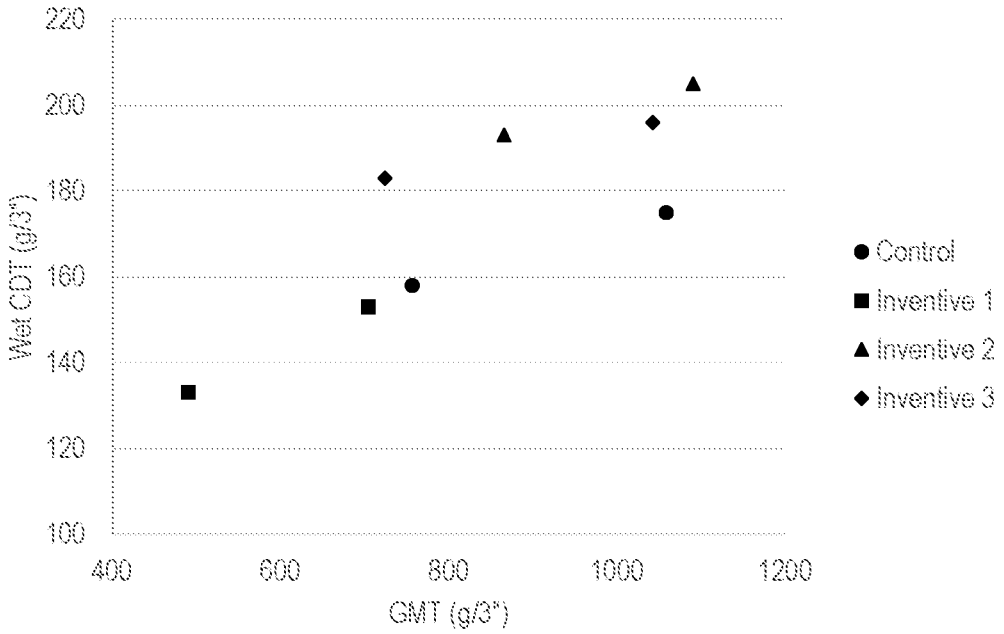
FIG. 5 is a graph illustrating wet cross-machine direction tensile (Wet CDT) having units of grams per three inches versus GMT having units of grams per three inches for various samples prepared as described herein.
Figure 6:
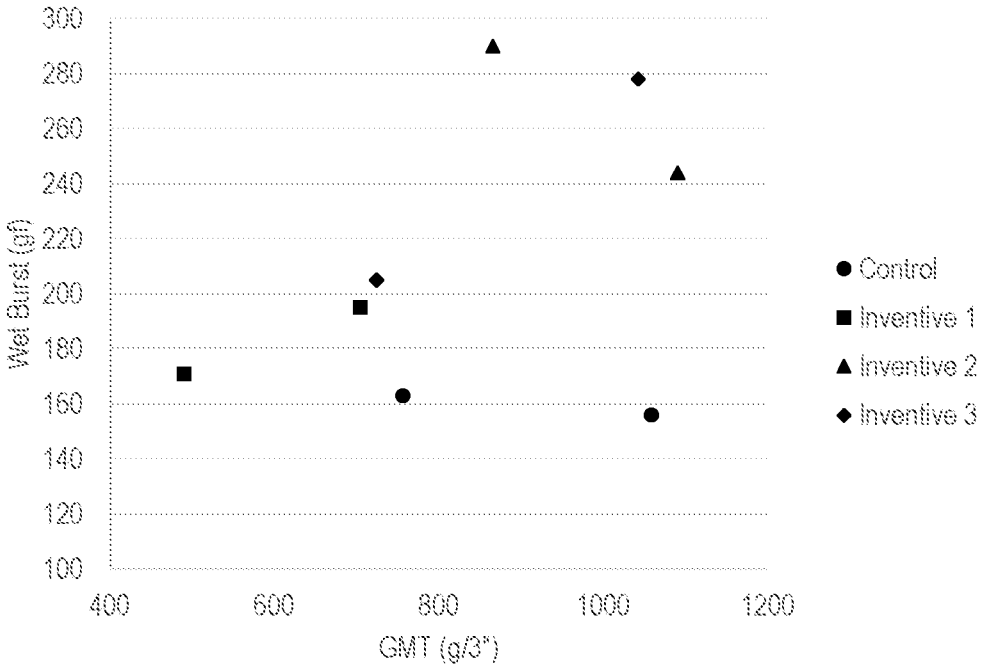
FIG. 6 is a graph illustrating wet burst strength (Wet Burst) having units of grams force versus GMT having units of grams per three inches for various samples prepared as described herein.

For example, referring to FIG. 2, shown is a method for making through-air dried paper sheets that may be used in accordance with this invention. (For simplicity, the various tensioning rolls schematically used to define the several fabric runs are shown but not numbered. It will be appreciated that variations from the apparatus and method illustrated in FIG. 2 can be made without departing from the scope of the invention). Shown is a twin wire former having a papermaking headbox 34, such as a layered headbox, which injects or deposits a stream 36 of an aqueous suspension of papermaking fibers onto the forming fabric 38 positioned on a forming roll 39. The forming fabric serves to support and carry the newly-formed wet web downstream in the process as the web is partially dewatered to a consistency of about 10 dry weight percent. Additional dewatering of the wet web can be carried out, such as by vacuum suction, while the wet web is supported by the forming fabric.

The wet web is then transferred from the forming fabric 38 to a transfer fabric 40. In one embodiment, the transfer fabric can be traveling at a slower speed than the forming fabric in order to impart increased stretch into the web. This is commonly referred to as a "rush" transfer. Preferably the transfer fabric can have a void volume that is equal to or less than that of the forming fabric. The relative speed difference between the two fabrics can be from 0 to 60 percent, more specifically from about 15 to 45 percent. Transfer is preferably carried out with the assistance of a vacuum shoe 42 such that the forming fabric and the transfer fabric simultaneously converge and diverge at the leading edge of the vacuum slot.

The web is then transferred from the transfer fabric 40 to the throughdrying fabric 44 with the aid of a vacuum transfer roll 46 or a vacuum transfer shoe, optionally again using a fixed gap transfer as previously described. The throughdrying fabric can be traveling at about the same speed or a different speed relative to the transfer fabric. If desired, the throughdrying fabric can be run at a slower speed to further enhance stretch. Transfer can be carried out with vacuum assistance to ensure deformation of the sheet to conform to the throughdrying fabric, thus yielding desired bulk and texture. Suitable throughdrying fabrics are described in U.S. Pat. Nos. 5,429,686 and 5,672,248, which are incorporated by reference.

In one embodiment, the throughdrying fabric contains high and long impression knuckles. For example, the throughdrying fabric can have from about 5 to about 300 impression knuckles per square inch which are raised at least about 0.005 inches above the plane of the fabric. During drying, the web can be macroscopically arranged to conform to the surface of the throughdrying fabric and form a textured, three-dimensional surface.

The side of the web contacting the throughdrying fabric is typically referred to as the "fabric side" of the tissue web. The fabric side of the tissue web, as described above, may have a shape that conforms to the surface of the throughdrying fabric after the fabric is dried in the throughdryer. The opposite side of the tissue web, on the other hand, is typically referred to as the "air side". The air side of the web may be smoother than the fabric side during normal throughdrying processes.

The level of vacuum used for the web transfers can be from about 3 to about 15 inches of mercury (75 to about 380 millimeters of mercury), preferably about 5 inches (125 millimeters) of mercury. The vacuum shoe (negative pressure) can be supplemented or replaced by the use of positive pressure from the opposite side of the web to blow the web onto the next fabric in addition to or as a replacement for sucking it onto the next fabric with vacuum. Also, a vacuum roll or rolls can be used to replace the vacuum shoe(s).

While supported by the throughdrying fabric, the web is dried to a consistency of about 94 percent or greater by the throughdryer 48 and thereafter transferred to a carrier fabric 50. The dried basesheet 52 is transported to the reel 54 using carrier fabric 50 and an optional carrier fabric 56. An optional pressurized turning roll 58 can be used to facilitate transfer of the web from carrier fabric 50 to fabric 56. Suitable carrier fabrics for this purpose are Albany International 84M or 94M and Asten 959 or 937, all of which are relatively smooth fabrics having a fine pattern. Although not shown, reel calendering or subsequent off-line calendering or embossing may be used.

In one embodiment, the reel 54 shown in FIG. 2 can run at a speed slower than the fabric 56 in a rush transfer process for building bulk into the tissue web 52. For instance, the relative speed difference between the reel and the fabric can be from about 5 to about 25 percent and, particularly from about 12 to about 14 percent. Rush transfer at the reel can occur either alone or in conjunction with a rush transfer process upstream, such as between the forming fabric and the transfer fabric.

In one embodiment, the tissue web 52 is a textured web which has been dried in a three-dimensional state such that the hydrogen bonds joining fibers were substantially formed while the web was not in a flat, planar state. For instance, the web can be formed while the web is on a highly textured throughdrying fabric or other three-dimensional substrate. Processes for producing uncreped throughdried fabrics are, for instance, disclosed in U.S. Pat. Nos. 5,672,248, 5,656,132 and 6,096,169.

According to the process of the current invention, numerous and different tissue products can be formed. In certain embodiments the tissue products may be single-ply tissue product. In an alternative embodiment, tissue webs made according to the present invention may be incorporated into multiple ply products. For instance, in one embodiment, a tissue web made according to the present invention can be attached to one or more other tissue webs for forming a wiping product having desired characteristics. The other webs laminated to the tissue web of the present invention can be, for instance, a wet-creped web, a calendered web, an embossed web, a through-air dried web, a creped through-air dried web, an uncreped through-air dried web and the like.

In certain preferred embodiments the present invention provides a rolled bath tissue product having a basis weight of about 30 gsm or greater, such as from about 30 to about 60 gsm. At the foregoing basis weights, the tissue products of the present invention may have a relatively high bulk. Tissue products made in accordance with the present invention, for instance, may have a bulk greater than 10.0 cc/g. For example, in one embodiment, the bulk of tissue products made according to the present invention may be about 12.0 cc/g or greater, such as about 14.0 cc/g or greater, such as about 16.0 cc/g or greater, such as from about 10.0 to 20.0 cc/g. In one particularly preferred embodiment the present invention provides a single-ply, through-air dried, creped, rolled bath tissue product comprising from about 5 to about 20 weight percent regenerated cellulose fiber, the product having a basis weight from about 40 to about 50 gsm and a sheet bulk from about as from about 12.0 to about 18.0 cc/g.

Generally, the tissue products of the present invention have a geometric mean tensile (GMT) strength of about 700 g/3" or greater, more preferably about 800 g/3" or greater, and still more preferably about 900 g/3" or greater, such as from about 700 to about 1,200 g/3", such as from about 800 to about 1,100 g/3". In one particularly preferred embodiment the present invention provides a single-ply, through-air dried, uncreped, tissue product comprising from about 5.0 to about 20 weight percent regenerated cellulose fiber, the product having a GMT from about 700 to about 1,200 g/3".

Despite having relatively high degrees of tensile strength, the tissue products of the present invention are relatively soft. For example, the tissue products may have a TS7 values of about 10.0 or less, more preferably about 9.5 or less, and still more preferably about 9.0 or less, such as from about 8.0 to about 10.0. In certain instances, the tissue products may have a GMT from about 700 to about 1,400 g/3" and a TS7 value less than about 10.0, such as from about 8.0 to about 10.0.

In other instances, the tissue products have improved flexibility and a low degree of stiffness. For example, the products may have a machine direction slope (MD Slope) of about 7.0 kg or less, such as about 6.0 kg or less, such as from about 3.0 to about 7.0 kg. The foregoing MD Slopes may generally be achieved at a GMT from about 700 to about 1,200 g/3". The products may also have a Stiffness Index of about 10.0 or less, such as about 8.0 or less, such as about 6.0 or less, such as from about 5.0 to about 10.0.

The products of the present invention also have improved durability, both when dry and wet. For example, in certain instances, the invention provides a through-air dried rolled bath tissue product comprising from about 5 to about 20 weight percent regenerated cellulose fiber and having a dry burst index of about 6.00 or greater and a GMT from about 700 to about 1,200 g/3". The improved dry durability generally does not come at the expense of performance when wet. For example, the tissue products generally have a Slosh time less than about 1 minute, such as from about 10 seconds to 1 minute, such as from about 10 seconds to about 45 seconds, such as from about 10 seconds to about 30 seconds. Surprisingly, the foregoing Slosh times are achieved despite the tissue products having relatively high wet cross-machine direction (CD) tensile strength, such as greater than about 125 g/3", such as greater than about 150 g/3", such as greater than about 170 g/3", such as from about 125 to about 200 g/3". In other instances, the tissue products of the present invention may have a CD Wet/Dry Ratio of about 25 percent or greater.

In still other embodiments the tissue products have improved wet burst strength, such as a wet burst of about 160 gf or greater, such as about 180 gf or greater, such as about 200 gf or greater, such as from 160 to about 300 gf. The foregoing wet burst strengths may generally be achieved at a GMT from about 700 to about 1,200 g/3".

Test Methods

Tissue Softness Analyzer

Softness and surface smoothness were measured using an EMTEC Tissue Softness Analyzer ("TSA") (Emtec Electronic GmbH, Leipzig, Germany). The TSA comprises a rotor with vertical blades which rotate on the tissue sample applying a defined contact pressure. The blades are pressed against the sample with a load of 100 mN and the rotational speed of the blades is two revolutions per second. Contact between the vertical blades and the tissue sample creates vibrations, which are sensed by a vibration sensor. The sensor transmits a signal to a PC for processing and display. The signal is displayed as a frequency spectrum. The frequency spectrum is analyzed by the associated TSA software to determine the amplitude of the frequency peak occurring in the range between 200 to 1000 Hz. This peak is generally referred to as the TS750 value (having units of dB V2 rms) and represents the surface smoothness of the tissue sample. A high amplitude peak correlates to a rougher surface, while a low amplitude peak correlates to a smoother surface. A further peak in the frequency range between 6 and 7 kHZ represents the softness of the sample. The peak in the frequency range between 6 and 7 kHZ is herein referred to as the TS7 value (having units of dB V2 rms). The lower the amplitude of the peak occurring between 6 and 7 kHZ, the softer the sample.

Tissue product samples were prepared by cutting a circular sample having a diameter of 112.8 mm. All samples were allowed to equilibrate at TAPPI conditions for at least 24 hours prior to completing the TSA testing. After conditioning each sample was tested as is, i.e., multi-ply products were tested without separating the sample into individual plies. The sample is secured, and the measurements are started via the PC. The PC records, processes and stores all of the data according to standard TSA protocol. The reported TS750 and TS7 values are the average of five replicates, each one with a new sample.

Basis Weight

Prior to testing, all samples are conditioned under TAPPI conditions (23±1° C. and 50±2 percent relative humidity) for a minimum of 4 hours. Basis weight of sample is measured by selecting twelve (12) products (also referred to as sheets) of the sample and making two (2) stacks of six (6) sheets. In the event the sample consists of perforated sheets of bath or towel tissue, the perforations must be aligned on the same side when stacking the usable units. A precision cutter is used to cut each stack into exactly 10.16×10.16 cm (4.0×4.0 inch) squares. The two stacks of cut squares are combined to make a basis weight pad of twelve (12) squares thick. The basis weight pad is then weighed on a top loading balance with a minimum resolution of 0.01 grams. The top loading balance must be protected from air drafts and other disturbances using a draft shield. Weights are recorded when the readings on the top loading balance become constant. The mass of the sample (grams) per unit area (square meters) is calculated and reported as the basis weight, having units of grams per square meter (gsm).

Caliper

Caliper is measured in accordance with TAPPI test methods Test Method T 580 pm-12 "Thickness (caliper) of towel, tissue, napkin and facial products." The micrometer used for carrying out caliper measurements is an Emveco 200-A Tissue Caliper Tester (Emveco, Inc., Newberg, OR). The micrometer has a load of 2 kilopascals, a pressure foot area of 2,500 square millimeters, a pressure foot diameter of 56.42 millimeters, a dwell time of 3 seconds and a lowering rate of 0.8 millimeters per second.

Tensile

Tensile testing is conducted on a tensile testing machine maintaining a constant rate of elongation and the width of each specimen tested is 3 inches. Testing is conducted under TAPPI conditions. Prior to testing samples are conditioned under TAPPI conditions (23±1° C. and 50±2 percent relative humidity) for at least 4 hours and then cutting a 3±0.05 inches (76.2±1.3 mm) wide strip in either the machine direction (MD) or cross-machine direction (CD) orientation using a JDC Precision Sample Cutter (Thwing-Albert Instrument Company, Philadelphia, PA, Model No. JDC 3-10, Serial No. 37333) or equivalent. The instrument used for measuring tensile strengths was an MTS Systems Sintech 11S, Serial No. 6233. The data acquisition software was MTS TestWorks® for Windows Ver. 3.10 (MTS Systems Corp., Research Triangle Park, NC). The load cell was selected from either a 50 Newton or 100 Newton maximum, depending on the strength of the sample being tested, such that the majority of peak load values fall between 10 to 90 percent of the load cell's full-scale value. The gauge length between jaws was 4±0.04 inches (101.6±1 mm) for facial tissue and towels and 2±0.02 inches (50.8±0.5 mm) for bath tissue. The crosshead speed was 10±0.4 inches/min (254±1 mm/min), and the break sensitivity was set at 65 percent. The sample was placed in the jaws of the instrument, centered both vertically and horizontally. The test was then started and ended when the specimen broke. The peak load was recorded as either the "MD tensile strength" or the "CD tensile strength" of the specimen depending on direction of the sample being tested. Ten representative specimens were tested for each product or sheet and the arithmetic average of all individual specimen tests was recorded as the appropriate MD or CD tensile strength having units of grams per three inches (g/3"). Tensile energy absorbed (TEA) and slope are also calculated by the tensile tester. TEA is reported in units of $g \cdot cm/cm^2$ and slope is recorded in units of kilograms (kg). Both TEA and Slope are directionally dependent and thus MD and CD directions are measured independently.

Wet tensile strength measurements are measured in the same manner as described above, but the previously conditioned sample strip is saturated with distilled water immediately prior to loading the specimen into the tensile test equipment. Preferably, prior to performing a wet tensile test, the sample is aged to ensure the wet strength resin has cured. Artificial aging may be used for samples that were to be tested immediately after or within days of manufacture. For artificially aging sample strips are heated for 4 minutes at 105±2° C. For natural aging, the samples are held at 22±2° C. and 50 percent relative humidity for a period of 12 days prior to testing.

Following aging the samples are wetted individually and tested. Sample wetting is performed by first laying a single test strip onto a piece of blotter paper (Fiber Mark, Reliance Basis 120). A pad is then used to wet the sample strip prior to testing. The pad is a green, Scotch-Brite brand (3M) general purpose commercial scrubbing pad. To prepare the pad for testing, a full-size pad is cut approximately 2.5 inches long by 4 inches wide. A piece of masking tape is wrapped around one of the 4-inch long edges. The taped side then becomes the "top" edge of the wetting pad. To wet a tensile strip, the tester holds the top edge of the pad and dips the bottom edge in approximately 0.25 inches of distilled water located in a wetting pan. After the end of the pad has been saturated with water, the pad is then taken from the wetting pan and the excess water is removed from the pad by lightly tapping the wet edge three times across a wire mesh screen. The wet edge of the pad is then gently placed across the sample, parallel to the width of the sample, in the approximate center of the sample strip. The pad is held in place for approximately one second and then removed and placed back into the wetting pan. The wet sample is then immediately inserted into the tensile grips so the wetted area is approximately centered between the upper and lower grips. The test strip should be centered both horizontally and vertically between the grips. (It should be noted that if any of the wetted portion comes into contact with the grip faces, the specimen must be discarded, and the jaws dried off before resuming testing.) The tensile test is then performed, and the peak load recorded as the wet tensile strength of this specimen. As with the dry tensile test, MD and CD directions are measured independently and ten representative specimens were tested for each product or sheet and the arithmetic average of all individual specimen tests was recorded as the appropriate MD or CD tensile strength.

All products were tested in their product forms without separating into individual plies.

Fiber Length

Tissue samples are prepared and stained as set forth in TAPPI T 401, which provides for the identification of the types of fibers present in a sample and their quantitative estimation. If the tissue sample includes more than one cellulosic fiber type, the different fiber types will accept the stain in a different fashion to allow identification of the particular fiber type(s) to be analyzed. The stained sample is then analyzed using an image analysis system to determine fiber length.

The image analysis system includes a computer having a frame grabber board, a stereoscope, a video camera, and image analysis software. A VH5900 monitor microscope and a video camera having a VH50 lens with a contact type illumination head, available from the Keyence Company of Fair Lawn, NJ, can be used. The stereoscope and video camera acquire the image to be recorded. The frame grabber board converts the analog signal of this image to a digital format readable by the computer.

The image saved to the computer file is measured using suitable software such as the Optimas Image Analysis software, version 3.0, available from the BioScan Company of Edmonds, WA.

The slide is placed on the stereoscope stage. The stereoscope is adjusted to a 15× magnification level. The stereoscope light source intensity is set to the maximum value, and the stereoscope aperture is set to the minimum aperture size in order to obtain the maximum image contrast. The Optimas software is run with the multiple mode set and AREA (area) and ARLENGTH (length) measurements selected.

Under "Sampling Options," the following default values are used: sampling units are selected, set number equals 64 intervals, and minimum boundary length is 10 samples. The following options are not selected: Remove Areas Touching Region of Interest (ROI), Remove Areas Inside Other Areas, and Smooth Boundaries. The software contrast and brightness settings are set to 0 and 170, respectively. The software threshold settings are set to 125 and 255.

The image analysis software is calibrated in millimeters with a metric ruler placed in the field of view. The calibration is performed to obtain a screen width of 6.12 millimeters.

The region of interest is selected so that no fibers intersect the boundary of the region of interest. The operator positions the slide and acquires the image data (area and length) in one field. The slide is then repositioned, and image data are acquired in a second field. Data collection is continued until data from the entire slide is acquired. The use of grid lines on the slide, while not essential, is highly useful to prevent the microscopist from missing an area or reading an area more than once. Fibers crossing the grid lines are not included in the data collection.

While it is desirable to have a slide composed solely of individual fibers which do not cross, inevitably some images comprised of crossed fibers will be created. Crossed fiber images are deleted with the paint option available in the Optimas software if none of the crossed fibers are unobstructed. Unobstructed fibers in crossed fiber images are retained by painting over those fibers in the crossed fiber image which are at least partially obstructed by other fibers.

The image analysis software provides the projected fiber surface area and the fiber length for each fiber image recorded with the image analysis system.

Burst Strength (Wet or Dry)

Burst Strength is measured using an EJA Burst Tester (series #50360, commercially available from Thwing-Albert Instrument Company, Philadelphia, PA). The test procedure is according to TAPPI T570 pm-00 except the test speed. The test specimen is clamped between two concentric rings whose inner diameter defines the circular area under test. A penetration assembly, the top of which is a smooth, spherical steel ball, is arranged perpendicular to and centered under the rings holding the test specimen. The penetration assembly is raised at 6 inches per minute such that the steel ball contacts and eventually penetrates the test specimen to the point of specimen rupture. The maximum force applied by the penetration assembly at the instant of specimen rupture is reported as the burst strength in grams force (gf) of the specimen.

The penetration assembly consists of a spherical penetration member which is a stainless steel ball with a diameter of 0.625±0.002 inches (15.88±0.05 mm) finished spherical to 0.00004 inches (0.001 mm). The spherical penetration member is permanently affixed to the end of a 0.375±0.010 inch (9.525±0.254 mm) solid steel rod. A 2000 gram load cell is used and 50 percent of the load range i.e. 0-1000 g is selected. The distance of travel of the probe is such that the upper most surface of the spherical ball reaches a distance of 1.375 inches (34.9 mm) above the plane of the sample clamped in the test. A means to secure the test specimen for testing consisting of upper and lower concentric rings of approximately 0.25 inches (6.4 mm) thick aluminum between which the sample is firmly held by pneumatic clamps operated under a filtered air source at 60 psi. The clamping rings are 3.50±0.01 inches (88.9±0.3 mm) in internal diameter and approximately 6.5 inches (165 mm) in outside diameter. The clamping surfaces of the clamping rings are coated with a commercial grade of neoprene approximately 0.0625 inches (1.6 mm) thick having a Shore hardness of 70-85 (A scale). The neoprene needs not cover the entire surface of the clamping ring but is coincident with the inner diameter, thus having an inner diameter of 3.50±0.01 inches (88.9±0.3 mm) and is 0.5 inches (12.7 mm) wide, thus having an external diameter of 4.5±0.01 inches (114±0.3 mm). For each test a total of 3 sheets of product are combined.

The sheets are stacked on top of one another in a manner such that the machine direction of the sheets is aligned. Where samples comprise multiple plies, the plies are not separated for testing. In each instance the test sample comprises 3 sheets of product. For example, if the product is a 2-ply tissue product, 3 sheets of product, totaling 6 plies are tested. If the product is a single ply tissue product, then 3 sheets of product totaling 3 plies are tested.

Samples are conditioned under TAPPI conditions for a minimum of four hours and cut into 127×127±5 mm squares. For wet burst measurement, after conditioning the samples were wetted for testing with 0.5 mL of deionized water dispensed with an automated pipette. The wet sample is tested immediately after insulting.

The peak load (gf) and energy to peak (g-cm) are recorded and the process repeated for all remaining specimens. A minimum of five specimens are tested per sample and the peak load average of five tests is reported.

Tear

Tear testing was carried out in accordance with TAPPI test method T-414 "Internal Tearing Resistance of Paper (Elmendorf-type method)" using a falling pendulum instrument such as Lorentzen & Wettre Model SE 009. Tear strength is directional, and machine direction (MD) and cross-machine direction (CD) tear are measured independently.

More particularly, a rectangular test specimen of the sample to be tested is cut out of the tissue product or tissue base sheet such that the test specimen measures 63±0.15 mm (2.5±0.006 inches) in the direction to be tested (such as the MD or CD direction) and between 73 and 114 mm (2.9 and 4.6 inches) in the other direction. The specimen edges must be cut parallel and perpendicular to the testing direction (not skewed). Any suitable cutting device, capable of the prescribed precision and accuracy, can be used. The test specimen should be taken from areas of the sample that are free of folds, wrinkles, crimp lines, perforations or any other distortions that would make the test specimen abnormal from the rest of the material.

The number of plies or sheets to test is determined based on the number of plies or sheets required for the test results to fall between 20 to 80 percent on the linear range scale of the tear tester and more preferably between 20 to 60 percent of the linear range scale of the tear tester. The sample preferably should be cut no closer than 6 mm (0.25 inch) from the edge of the material from which the specimens will be cut. When testing requires more than one sheet or ply the sheets are placed facing in the same direction.

The test specimen is then placed between the clamps of the falling pendulum apparatus with the edge of the specimen aligned with the front edge of the clamp. The clamps are closed and a 20-millimeter slit is cut into the leading edge of the specimen usually by a cutting knife attached to the instrument. For example, on the Lorentzen & Wettre Model SE 009 the slit is created by pushing down on the cutting knife lever until it reaches its stop. The slit should be clean with no tears or nicks as this slit will serve to start the tear during the subsequent test.

The pendulum is released and the tear value, which is the force required to completely tear the test specimen, is recorded. The test is repeated a total of ten times for each sample and the average of the ten readings reported as the tear strength. Tear strength is reported in units of grams of force (gf). The average tear value is the tear strength for the direction (MD or CD) tested. The "geometric mean tear strength" is the square root of the product of the average MD tear strength and the average CD tear strength. The Lorentzen & Wettre Model SE 009 has a setting for the number of plies tested. Some testers may need to have the reported tear strength multiplied by a factor to give a per ply tear strength. For base sheets intended to be multiple ply products, the tear results are reported as the tear of the multiple ply product and not the single ply base sheet. This is done by multiplying the single ply base sheet tear value by the number of plies in the finished product. Similarly, multiple ply finished product data for tear is presented as the tear strength for the finished product sheet and not the individual plies. A variety of means can be used to calculate but in general will be done by inputting the number of sheets to be tested rather than the number of plies to be tested into the measuring device. For example, two sheets would be two 1-ply sheets for 1-ply product and two 2-ply sheets (4-plies) for 2-ply products.

Slosh Time

Slosh time is determined by the Slosh Box Test, which uses a bench-scaled apparatus to evaluate the breakup or dispersibility of flushable consumer products as they travel through the wastewater collection system. In this test, a clear plastic tank was loaded with a product and tap water or raw wastewater. The container was then moved up and down by a cam system at a specified rotational speed to simulate the movement of wastewater in the collection system. The initial breakup point and the time for dispersion of the product into pieces measuring 1×1 inch (25×25 mm) were recorded in the laboratory notebook. This 1×1 inch (25×25 mm) size is a parameter that is used because it reduces the potential of product recognition. The various components of the product were then screened and weighed to determine the rate and level of disintegration.

The slosh box water transport simulator consisted of a transparent plastic tank that was mounted on an oscillating platform with speed and holding time controller. The angle of incline produced by the cam system produces a water motion equivalent to 60 cm/s (2 ft/s), which is the minimum design standard for wastewater flow rate in an enclosed collection system. The rate of oscillation was controlled mechanically by the rotation of a cam and level system and was measured periodically throughout the test. This cycle mimics the normal back and forth movement of wastewater as it flows through sewer pipe.

Room temperature tap water was placed in the plastic container/tank. The timer was set for six hours (or longer) and cycle speed is set for 26 rpm. The pre-weighed product was placed in the tank and observed as it underwent the agitation period. The time to first breakup and full dispersion were recorded in the laboratory notebook.

The test was terminated when the product reached a dispersion point of no piece larger than 1×1 inch (25×25 mm) square in size. At this point, the clear plastic tank was removed from the oscillating platform. The entire contents of the plastic tank were then poured through a nest of screens arranged from top to bottom in the following order: 25.40 mm, 12.70 mm, 6.35 mm, 3.18 mm, 1.59 mm (diameter opening). With a showerhead spray nozzle held approximately 10 to 15 cm (4 to 6 in) above the sieve, the material was gently rinsed through the nested screens for two minutes at a flow rate of 4 L/min (1 gal/min) being careful not to force passage of the retained material through the next smaller screen. After two minutes of rinsing, the top screen was removed and the rinsing continued for the next smaller screen, still nested, for two additional minutes. After rinsing was complete, the retained material was removed from each of the screens using forceps. The contents were transferred from each screen to a separate, labeled aluminum weigh pan. The pan was placed in a drying oven overnight at 103±3° C. The dried samples were allowed to cool down in a desiccator. After all the samples were dry, the materials from each of the retained fractions were weighed and the percentage of disintegration based on the initial starting weight of the test material were calculated. Generally, a break-up time into pieces less than 25×25 mm of 100 minutes or less is considered very good, and a break-up time into pieces less than 25×25 mm of 180 minutes is considered to be the maximum acceptable value for flushability.

EXAMPLES

A pilot tissue machine was used to produce a layered, uncreped through-air dried ("UCTAD") basesheet in accordance with this invention generally as described in FIG. 2. The resulting basesheet was converted into rolled bath tissue products comprising two tissue plies in a conventional manner.

The basesheet was made from a stratified fiber furnish containing a center layer of fibers (40 percent by weight of the basesheet) positioned between two outer layers of fibers (each outer layer comprising 30 percent by weight of the basesheet). The first outer layer contacted the through-air drying fabric during manufacture (fabric layer). In all instances the furnish forming the center layer was subjected to refining to control the strength of the resulting basesheet. A debonding agent (ProSoft® TQ1003, Solenis, Wilmington, DE) was added to the furnish forming the fabric layer. For each sample, control, inventive 1 and inventive 2, basesheets were prepared at two different target strengths. Strength was controlled by refining the furnish forming the center layer.

The control codes contained a Northern softwood kraft pulp (NSWK) and eucalyptus hardwood kraft pulp (EHWK). The inventive codes were prepared by replacing a portion of the NSWK or EHWK fibers with regenerated cellulose fibers (DANUFIL® Short Cut Viscosefibre, Kelheim Fibres GmbH). The regenerated cellulose fibers (RCF) had a fiber length of 3.0 mm and a linear density of about 0.9 dtex. The furnish composition of each layer is summarized in Table 1, below. The weight percentages in Table 1 reflect the weight percentage of a given furnish based upon the total weight of the basesheet.

TABLE 1

| Sample | Fabric Layer (wt %) | Middle Layer (wt %) | Air Layer (wt %) |
|---|---|---|---|
| Control 1 | EHWK (30%) | NSWK (40%) | EHWK (30%) |
| Inventive 1 (20 wt % RSF) | EHWK (20%) RCF (10%) | NSWK (40%) | EHWK (20%) RCF (10%) |
| Inventive 2 (20 wt % RSF) | EHWK (30%) | NSWK (20%) RCF (20%) | EHWK (30%) |
| Inventive 3 (20 wt % RSF) | EHWK (23.5%) RCF (6.5%) | NSWK (33.5%) RCF (6.5%) | EHWK (23.5%) RCF (6.5%) |

The fiber furnish was diluted to approximately 0.2 percent consistency and delivered to a layered headbox. The basesheet was then rush transferred to a transfer fabric (Fred, described in U.S. Pat. No. 7,611,607 and commercially available from Voith Fabrics, Appleton, WI) traveling 28 percent slower than the forming fabric using a vacuum roll to assist the transfer. At a second vacuum-assisted transfer, the basesheet was transferred and wet-molded onto the throughdrying fabric (described in U.S. Pat. No. 10,610,063 and commercially available from Voith Fabrics, Appleton, WI). The sheet was dried with a through-air dryer resulting in a basesheet having an air-dry basis weight of about 48 grams per square meter (gsm).

Basesheet was converted to single-ply rolled products by calendering using a conventional polyurethane/steel calenders comprising a 40 P&J polyurethane roll on the air side of the sheet and a standard steel roll on the fabric side. The calendar nip load was 100 pli. After calendering the webs were spirally wound onto a core. The physical properties of the resulting rolled single-ply rolled bath tissue products are summarized in Tables 2 and 3, below. The physical properties are further illustrated in FIGS. 3-6.

TABLE 2

| Sample | Basis Wt. (gsm) | Sheet Bulk (cc/g) | GMT (g/3") | GM Slope | Stiffness Index | Dry Burst | Burst Index |
|---|---|---|---|---|---|---|---|
| Control 1, 1 | 46.4 | 11.3 | 756 | 6.37 | 8.43 | 577 | 7.63 |
| Control 1, 2 | 46.7 | 11.0 | 1058 | 7.39 | 6.99 | 766 | 7.24 |
| Inventive 1, 1 | 46.8 | 11.1 | 704 | 6.57 | 9.33 | 420 | 5.96 |
| Inventive 1, 2 | 46.0 | 11.1 | 490 | 5.43 | 11.07 | 262 | 5.34 |
| Inventive 2, 1 | 43.7 | 11.4 | 865 | 5.79 | 6.70 | 586 | 6.78 |
| Inventive 2, 2 | 43.8 | 11.4 | 1090 | 6.55 | 6.01 | 759 | 6.97 |
| Inventive 3, 1 | 44.6 | 11.4 | 1042 | 6.98 | 6.70 | 720 | 6.91 |
| Inventive 3, 2 | 43.5 | 11.5 | 724 | 5.69 | 7.87 | 497 | 6.86 |

TABLE 3

| Sample | CDT (g/3") | Wet CDT (g/3") | Wet:Dry Ratio | Wet Burst (gf) | Slosh (sec.) | TS7 |
|---|---|---|---|---|---|---|
| Control 1 | 574 | 158 | 28% | 163 | 58.2 | 11.55 |
| Control 2 | 853 | 175 | 21% | 156 | 55.1 | 11.97 |
| Inventive 1, 1 | 520 | 153 | 29% | 195 | 20.9 | 9.80 |
| Inventive 1, 2 | 352 | 133 | 38% | 171 | 16.9 | 8.47 |
| Inventive 2, 1 | 633 | 193 | 30% | 290 | 54.4 | 8.83 |
| Inventive 2, 2 | 777 | 205 | 26% | 244 | 47.8 | 9.75 |
| Inventive 3, 1 | 752 | 196 | 26% | 278 | 45.6 | 9.26 |
| Inventive 3, 2 | 528 | 183 | 35% | 205 | 35.6 | 8.49 |

To further explore the effect of adding RCF fiber to each layer of a stratified web, particularly wet sheet properties such as wet cross-machined direction tensile (wet CDT) and wet burst strength, additional inventive and control samples were prepared. Each sample was prepared substantially as described above at three different target strengths (low, medium, and high). In each instance strength was controlled by refining the NSWK furnish. The furnish composition of each lay is summarized in Table 4, below. The weight percentages in Table 4 reflect the weight percentage of a given furnish based upon the total weight of the basesheet.

TABLE 4

| Sample | Fabric Layer (wt %) | Middle Layer (wt %) | Air Layer (wt %) |
|---|---|---|---|
| Control 2 | EHWK (30%) | NSWK (40%) | EHWK (30%) |
| Inventive 4 (10 wt % RSF) | EHWK (26.7%) RCF (3.3%) | NSWK (37.7%) RCF (3.3%) | EHWK (26.7%) RCF (3.3%) |

The physical properties of the resulting rolled single-ply rolled bath tissue products are summarized in Table 5 below.

TABLE 5

| Sample | GMT (g/3") | Wet Burst (gf) | Wet CDT (g/3") |
|---|---|---|---|
| Control 2, 1 | 926 | 67 | 92 |
| Control 2, 2 | 1135 | 73 | 98 |
| Control 2, 3 | 1236 | 79 | 91 |
| Inventive 4, 1 | 1473 | 257 | 151 |
| Inventive 4, 2 | 1525 | 254 | 155 |
| Inventive 4, 3 | 1705 | 278 | 156 |

The foregoing examples illustrate that the improvement in physical properties, particularly wet physical properties such as wet burst and wet CD tensile, are surprisingly enhanced when the regenerated cellulose fibers are disposed in at least the center layer of a multi-layered product and particularly when the regenerated cellulose fibers replaced long wood pulp fibers, such as NSWK. Although, it is beneficial to dispose the regenerated cellulose fibers in the center layer, it is also beneficial to dispose the regenerated cellulose fibers throughout the stratified web, such that regenerated cellulose fibers are disposed in each of the layers and particularly when the amount of regenerated cellulose fibers in each of the layers is approximately equal.

While the invention has been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto and the following embodiments:

Embodiment 1: A wet-laid tissue product comprising regenerated cellulose fibers providing 25 percent or less of the total weight of the wet-laid tissue product, the regenerated cellulose fibers comprising a linear density of less than about 1.0 dtex and a fiber length of less than about 6.0 mm.

Embodiment 2: The wet-laid tissue product of embodiment 1, wherein the regenerated cellulose has a linear density of about 0.9 dtex.

Embodiment 3: The wet-laid tissue product of embodiment 1 or 2, wherein the regenerated cellulose fibers include an average diameter of less than 10.0 μm.

Embodiment 4: The wet-laid tissue product of any one of the preceding embodiments, wherein the regenerated cellulose fibers provide between 1.0 to 20.0 percent of the total weight of the wet-laid tissue product.

Embodiment 5: The wet-laid tissue product of embodiment 4, wherein the regenerated cellulose fibers provide between 5.0 to 10.0 percent of the total weight of the wet-laid tissue product.

Embodiment 6: The wet-laid tissue product of any one of the preceding embodiments, further comprising Northern softwood kraft fibers, wherein the Northern softwood kraft fibers provide between 25 to 35 percent of the total weight of the wet-laid tissue product.

Embodiment 7: The wet-laid tissue product of any one of the preceding embodiments, wherein the wet-laid tissue product includes only a single ply.

Embodiment 8: The wet-laid tissue product of any one of the preceding embodiments, wherein the wet-laid tissue product is through-air dried.

Embodiment 9: The wet-laid tissue product of any one of the preceding embodiments, wherein the wet-laid tissue product comprises a stratified web having a first outer layer, a middle layer and second outer layer, wherein the regenerated cellulose fibers are selectively disposed in the middle layer and the outer layers are substantially free from regenerated fibers.

Embodiment 10: The wet-laid tissue product of any one of the preceding embodiments, wherein the wet-laid tissue product comprises a stratified web having a first outer layer, a middle layer and second outer layer, wherein the regenerated cellulose fibers are disposed in each of the layers.

Embodiment 11: The wet-laid tissue product of any one of the preceding embodiments, having a GMT from about 700 to about 1,200 g/3".

Embodiment 13: The wet-laid tissue product of any one of the preceding embodiments, having a basis weight from about 35 to about 50 gsm and a sheet bulk of about 10.0 cc/g or greater.

Embodiment 14: The wet-laid tissue product of any one of the preceding embodiments, having an MD Slope of about 6.0 or less.

Embodiment 15: The wet-laid tissue product of any one of the preceding embodiments, having a Wet/Dry Ratio of about 25 percent or greater and a Slosh time of about 1 minute or less.

Embodiment 16: The wet-laid tissue product of any one of the preceding embodiments, having a wet CD tensile of about 175 g/3" or greater and a wet burst of about 200 gf or greater.

What is claimed is:

1. A single-ply, through-air dried tissue product comprising a stratified web having a first outer layer, a middle layer and second outer layer and from about 5 to about 25 weight percent regenerated cellulose fibers having a fiber length of at least about 2.0 mm and wood pulp fibers, wherein the regenerated cellulose fibers are disposed in the middle layer and the outer layers, the product having a geometric mean tensile strength (GMT) from 700 to about 1,200 g/3", a wet cross-machine direction tensile from 125 to about 200 g/3", a wet burst from 160 to about 300 gf and a TS7 value of about 10.0 or less.

2. The tissue product of claim 1 the regenerated cellulose fibers having a linear density from about 0.3 to about 1.5 dtex and a fiber length from about 2.0 to about 4.0 mm.

3. The tissue product of claim 1 comprising from about 5.0 to about 25 weight percent regenerated cellulose fibers.

4. The tissue product of claim 1 wherein the tissue product is uncreped.

5. The tissue product of claim 1 having a machine direction slope (MD Slope) from about 3.0 to about 7.0 kg.

6. The tissue product of claim 1 having a CD Wet/Dry Ratio from about 25 percent or greater.

7. A rolled bath tissue product comprising a single-ply uncreped throughdried tissue product spirally wound around a core, the single ply having a first outer layer, a middle layer and a second outer layer, wherein each of the layers comprise regenerated cellulose fibers having a fiber length of at least about 2.0 mm and the amount of regenerated cellulose fibers in the product ranges from about 5.0 to about 20 weight percent, the tissue product having a GMT from about 700 to about 1,200 g/3", a wet cross-machine direction tensile from 125 to about 200 g/3", a wet burst from 160 to about 300 gf and a TS7 value less than about 10.0.

8. The rolled bath tissue product of claim 7 wherein the regenerated cellulose fibers have a linear density from about 0.3 to about 1.5 dtex and a fiber length from about 2.0 to about 4.0 mm.

9. The rolled bath tissue product of claim 7 comprising from about 5.0 to about 25 weight percent regenerated cellulose fibers.

10. The rolled bath tissue product of claim 7 wherein the tissue product is uncreped.

11. The rolled bath tissue product of claim 7 having a machine direction slope (MD Slope) from about 3.0 to about 7.0 kg.

12. The rolled bath tissue product of claim 7 having a CD Wet/Dry Ratio from about 25 percent or greater.

13. The rolled bath tissue product of claim 7 having a CD Wet/Dry Ratio from about 25 percent or greater, a wet cross-machine direction tensile from 125 to about 200 g/3" and a Slosh time of about 1 minute or less.

14. The rolled bath tissue product of claim 7 having a CD Wet/Dry Ratio from about 25 percent or greater, a wet burst from 160 to about 300 gf and a Slosh time of about 1 minute or less.

15. The rolled bath tissue product of claim 7 having a wet cross-machine direction tensile from 125 to about 200 g/3", a wet burst from 160 to about 300 gf and a Slosh time of about 1 minute or less.

* * * * *